US008941484B2

(12) United States Patent
Vacha et al.

(10) Patent No.: US 8,941,484 B2
(45) Date of Patent: Jan. 27, 2015

(54) SYSTEM AND METHOD OF ANOMALY DETECTION

(71) Applicant: Honeywell International Inc., Morristown, NJ (US)

(72) Inventors: Pavel Vacha, Prague (CZ); Vit Libal, Prague (CZ); Valerie Guralnik, Mound, MN (US)

(73) Assignee: Honeywell International Inc., Morristown, NJ (US)

( * ) Notice: Subject to any disclaimer, the term of this patent is extended or adjusted under 35 U.S.C. 154(b) by 135 days.

(21) Appl. No.: 13/800,443

(22) Filed: Mar. 13, 2013

(65) Prior Publication Data

US 2014/0266683 A1 Sep. 18, 2014

(51) Int. Cl.

| | |
|---|---|
| ***G08B 19/00*** | (2006.01) |
| ***G08B 23/00*** | (2006.01) |
| ***G08B 26/00*** | (2006.01) |
| ***G08B 25/00*** | (2006.01) |
| ***G08B 29/18*** | (2006.01) |
| ***G08B 31/00*** | (2006.01) |

(52) U.S. Cl.

CPC ..... *G08B 25/008* (2013.01); *G08B 29/188* (2013.01); *G08B 31/00* (2013.01)

USPC ..... 340/521; 340/522; 340/517; 340/528

(58) Field of Classification Search

CPC ..... G06K 19/0723; G06K 19/07345; G06K 17/00; G06K 17/0025; G07C 9/00158; G01S 13/589; G01S 13/765; G01S 3/52; G01S 13/04; G01S 13/825; G01S 19/21; G01S 19/30; G01P 13/04; H03M 3/04

USPC ..... 340/521, 528, 517

See application file for complete search history.

(56) References Cited

U.S. PATENT DOCUMENTS

| | | | | |
|---|---|---|---|---|
| 3,731,305 | A * | 5/1973 | Gehman | 342/28 |
| 3,794,978 | A * | 2/1974 | Staron | 375/367 |
| 3,875,394 | A * | 4/1975 | Shapely et al. | 702/72 |
| 4,026,654 | A * | 5/1977 | Beaurain | 356/5.07 |

(Continued)

OTHER PUBLICATIONS

Vineet Joshi and Raj Bhatnagar, CBOF: Cohesiveness-Based Outlier Factor, A Novel Definition of Outlier-ness, p. 1-15.*

(Continued)

*Primary Examiner* — Daniel Wu
*Assistant Examiner* — Emily C Terrell
(74) *Attorney, Agent, or Firm* — Husch Blackwell LLP

(57) ABSTRACT

A method and apparatus wherein the method includes detecting a plurality of events within a security system, evaluating the events using one of a first expression defined by $\Sigma_{r\in Q}\mathrm{conf}(f(r)-\mathrm{mrg}(r))$, a second expression defined by $\int_{r\in R}|f(r)-\mathrm{mrg}(r)|dr$ and a third expression defined by $\int_{r\in R}\mathrm{conf}(f(r)-\mathrm{mrg}(r))dr$, where r is a size of a neighborhood around a data point, f(r) is a Local Correlation Integral (LOCI) of r, mrg(r) is a margin of r, R is a predetermined set of intervals of neighborhood sizes, Q is a predetermined discrete set of neighborhood sizes and conf(d) is a non-linear confidence function being 0 for near distance to the data point and quickly approaching 1 for larger distances, comparing a value of the evaluated expression with a threshold value and setting an alarm upon detecting that the value exceeds the threshold value.

19 Claims, 1 Drawing Sheet

(56) References Cited

U.S. PATENT DOCUMENTS

| | | | | |
|---|---|---|---|---|
| 4,363,130 | A * | 12/1982 | Ramsay et al. | 380/35 |
| 5,553,081 | A * | 9/1996 | Downey et al. | 714/709 |
| 6,917,331 | B2 * | 7/2005 | Gronemeyer | 342/378 |
| 8,064,500 | B2 * | 11/2011 | Muto | 375/150 |
| 8,680,995 | B2 * | 3/2014 | G et al. | 340/541 |
| 2007/0047635 | A1 * | 3/2007 | Stojanovic et al. | 375/229 |
| 2007/0177694 | A1 * | 8/2007 | Okunev et al. | 375/333 |
| 2007/0195866 | A1 * | 8/2007 | Seibert et al. | 375/150 |
| 2009/0195354 | A1 * | 8/2009 | Levin et al. | 340/5.8 |

OTHER PUBLICATIONS

Thomas Richard McEvoy et al. An Algebra for the Detection and Prediction of Malicious Activity in Concurrent Systems, pp. 1-9.*

* cited by examiner

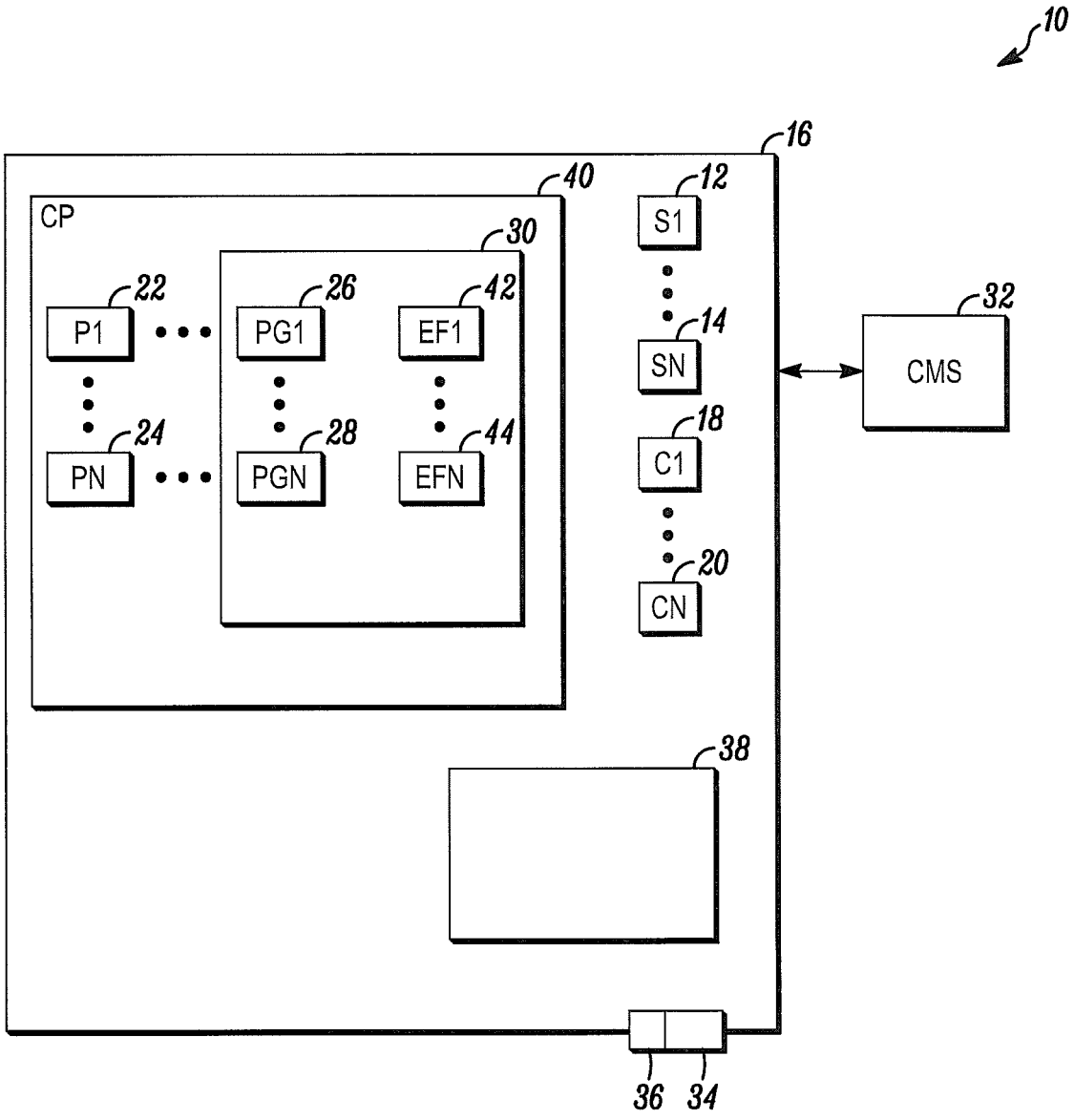
10
16
40
CP
30
22
P1
26
PG1
42
EF1
24
PN
28
PGN
44
EFN
12
S1
14
SN
18
C1
20
CN
32
CMS
38
36
34

SYSTEM AND METHOD OF ANOMALY DETECTION

FIELD

The field of the invention relates to physical security systems and more particularly to methods of detecting anomalous behavior by users of the security system.

BACKGROUND

Security systems are generally known. Such system typically include a number of sensors that detect security threats associated a secured area. The security threats may include those posed by intruders or by environmental threats such as fire, smoke or natural gas.

Included around the secured area may be a physical barrier (e.g., wall, fence, etc.) that prevents intruders from entering the secured area. A number of portals (e.g., doors, windows, etc.) may be provided around the periphery of the secured area to allow entry into or egress from the secured area.

The doors allowing entrance into the secured area, in turn, may be controlled by a card reader and electric lock that together restrict access through the portal to authorized persons. Each time a card is swiped through the card reader, the reader reads a user identifier from the card and allows access if the identity on the card matches a reference identifier.

While such systems work well, the cards used in such systems can be lost or stolen. Accordingly, a need exists for methods of detecting the unauthorized use of such cards.

BRIEF DESCRIPTION OF THE DRAWING

FIG. 1 is a block diagram of a security system shown generally in accordance with an illustrated embodiment.

DETAILED DESCRIPTION OF AN ILLUSTRATED EMBODIMENT

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

FIG. 1 is a block diagram of a security system shown generally in accordance with an illustrated embodiment. Included within the security system may be a number of sensors 12, 14 used to detect security threats within one or more secured areas 16 of the security system. In this regard, the secured area may be divided into a number of different security zones 38 with different levels of security.

Under one illustrated embodiment, the sensors may include one or more limit switches mounted to portals (e.g., doors, windows, etc.) that provide entrance into or egress from the secured area. In this way, the sensors may be used to detect intruders entering the secured area.

The sensors may also include one or more environmental detectors (e.g., fire, smoke, natural gas, etc.). The environmental detectors may be used to activate an audible/visual alarm as an indication that the secured area should be evacuated.

Also included within the system may be one or more processor apparatus (processors) 22, 24 located within a control panel 40 of the security system. The processors may operate under control of one or more computer programs 26, 28 loaded from a non-transitory computer readable medium (memory) 30. As used herein, reference to a step performed by a program (or the system) is also a reference to the processor that executed that step of the program.

During normal operation, an alarm processor may monitor a status of each of the sensors for security threats. Upon detecting a threat, the alarm processor may compose an alarm message and send that message to a central monitoring station 32. The central monitoring station may respond by alerting the proper authorities (e.g., police department, fire department, etc.).

In addition to detecting activation of one or more of the sensors, a monitoring processor may also save a record of the event into an event file 42, 44. The record may include an identifier of the sensor activated, a location of the activated sensor and a time of activation.

Also included within or along a periphery of the secured area or zones may be one or more cameras 18, 20. The cameras may operate to collect sequences of video frames and save the images of those frames into memory.

The cameras may operate continuously or only upon the detection of motion within a portion of the secured area. In the regard, motion may be detected via a sensor (e.g., a passive infrared (PIR) sensor) or by operation of a video processor that compares pixel values of successive frames to detect changes consistent with movement of a human within a field of view of the camera.

In some cases, such as motion in a high security area of one of the secured zones, the detection of motion may be regarded as a security threat and an alarm may be raised in accordance with a level of the threat. In other cases, the detection of motion may simply cause the security system to record a sequence of video frames for later evaluation and action. In either case, a record of the event may be saved in an event file. The record may contain an identifier of the camera, the location of the camera and a time of activation.

Located along a periphery of each of the secured area and/or zones may be one or more portals (e.g., doors) 34 that provides entry into and egress from one or more of the secured areas or zones to authorized users. The doors may be provided with an appropriate lock that denies physical entry of unauthorized persons (i.e., intruders) into the secured area.

Associated with the entry doors may be an access control system 36. The access control system may include a recognition device (e.g., card reader, keypad, etc.) coupled to an electric lock. In order to gain entry to the secured area, an authorized person may enter a personal identification number or swipe a card through a card reader in order to activate the electric lock and gain entry to or egress from the secured area.

Each of the access control systems may be monitored and controlled by an access processor within the control panel. In this regard, the access processor may receive identifiers of persons seeking access to one of the secured areas or zones and compare those identifiers with a list of authorized persons for each corresponding secured area or zone. Upon determining that the person seeking access is authorized, the access processor may send a signal opening the electric lock and granting access to that person into the secured area.

Upon granting access, the access processor may create and save a record of that access into an event file. The information saved within the event file may include an identifier of the person and of the secured area and a time of access.

Also included within the system may be one or more event processors that detect trouble with the system or other potential security threats. Potential security threats may include loss of video from a camera or activation of one of the sensors that would otherwise not cause an alarm or activation of an alarm sensor while the system is in a disarmed state. In each case, upon detecting an indication of trouble, the trouble processor may save a record of the event into an event file. The record may include an identifier of the type of trouble, the sensor, camera of other device involved and a time of the event.

In general, the event files of a security system can be an important source of information that can be used to address and identify security vulnerabilities and developing threats. For example, the loss of video from a particular camera may be a simple case of equipment failure or it could be the result of someone intentionally disabling a camera for a short period of time in order to obscure some criminal act.

Similarly, in the case of an organization that secures an area to carry out some enterprise, the saved events caused by the activities of the employees of the organization may be used as an important source of information in detecting disloyal employees or patterns of activity. For example, an employee assigned to some function within a first zone of the secured area may suddenly begin accessing other zones without any apparent reason for doing so. This may indicate that the employee is engaging in some illegal activity or is simply looking for a way to defeat one or more sensors of the security system.

Similarly, a criminal may steal or otherwise come into possession of an access card from an authorized user and attempt to use the access card to gain entry to the secured area during an off-shift or a period when the secured area is, otherwise, vacant. The use of the access card during a time period when an authorized user would not normally use his/her card could be an indication of a security threat.

Under one illustrated embodiment, one or more event processors detect events saved into the event files as they occur in real time. Similarly, one or more threat evaluation processors identify similar past or contemporaneous events and assess threats based upon deviations between the current event and past events. The identification of similar events may be based upon a particular employee, upon a particular sensor, upon a time period, upon a location of an event or upon any of a number of other different unifying factors.

Under the illustrated embodiment, a grouping processor may process the data within the event files to consolidate the events $p_i$ into a set of objects P (where $P=\{p_1, \ldots, p_i, \ldots, p_N\}$) under any of a number of the different unifying factors. Unifying factors may be based upon an identifier of the switch or card reader that triggers the event, the time of the event, an identifier of the person that causes the event or any of a number of other factors that indicate a common source. Once consolidated based upon the unifying factors, the events may be processed to identify any currently detected event that appear as an outlier and that indicates the statistical possibility of a security threat. Upon detecting such an event, an alert or alarm may be set by the alarm processor.

Under the illustrated embodiment, the grouped data may be processed by a LOCI processor using a Local Correlation Integral (LOCI) method. For example, consider the situation where a particular sensor is activated. In this case, past events involving the same sensor may be evaluated by grouping such events on an x-y basis by considering interval between activations of the sensor on the x-axis and the number of activations of the sensor on the y-axis (or vice versa). The processor may perform a range-search for all objects that are closer than some maximum radius value $r_{max}$ from a center object $p_i$. The objects may then be sorted to form an ordered list $D_i$ based upon their distance to the center object $p_i$. A value n of the number of r-neighbors of $p_i$ is determined (i.e., $n(p_i,r)\equiv|N(p_i, r)|$, where $N(p_i,r)\equiv\{p\in P|d(p,p_i)\leq r\}$. An average of n (i.e., $\hat{n}$) over the set of r-neighbors is determined $$\left(\text{i.e., } \hat{n}(p_i, r, \alpha) \equiv \frac{\sum_{p\in N(p_i,r)} N(p, \alpha r)}{n(p_i, r)}\right).$$

A standard deviation of $n(p, \alpha r)$ (i.e., $\sigma_{\hat{n}}(p_i, r, \alpha)$) may be determined over a set of r-neighbors of $p_i$ $$\left(\text{i.e., } \sigma_{\hat{n}}(p_i, r, \alpha) \equiv \sqrt{\frac{\sum_{p\in N(p_i,r)} (n(p, \alpha r) - \hat{n}(p_i, r, \alpha))^2}{n(p_i, r)}}\right).$$

The steps performed by the LOCI processor can be summarized by the pseudo-code as follows.

```
//Pre-processing
For each p_i ∈ P:
        Perform a range-search for N_i = {p ∈ P|d(p_i,p) ≤
        r_max}
        From N_i, construct a sorted list D_i of the critical
        and α-
                critical distances of p_i
//Post-processing
For each p_i ∈ P,
        For each radii r ∈ D_i (ascending):
                Update n(p_i, αr) and n̂(p_i,r,α)
                        From n and n̂, compute
                                σ_n̂(p_i,r,α).
```

Prior art methods of detecting anomalies extract statistics from the event files and classify each access event based on a computed anomaly score. The computed anomaly score characterizes how much the access event deviates from normality as characterized by a recorded statistics model. The prior art LOCI model classifies an event according to an anomaly function expressed in different scales. However, the number of available scales indirectly depends on the number of training samples, which makes the function vulnerable to changes in the number of samples. Consequently, an increase in the number of training samples may, somewhat surprisingly, lead to an increase in false alarms instead of their reduction.

The system described herein solves this problem by introducing three methods of definition and computation of the anomaly score that increase robustness against changes in the size of the training sample data set. In addition, the described methods deliver more consistent results after any update of the statistical model with new training samples.

The described methods classify a data point that defines an event based on its LOCI function f(r) where r is the size of the neighborhood around the point. In contrast with the original LOCI method, where the point is considered to be an anomaly if there exists a single r where f(r) falls outside of a margin value mrg(r) (e.g., 3 sigma (3σ)), formed around the average LOCI function, the described methods classify anomalies based on combinations of one or more and possibly all neighborhood sizes taking into account their significance.

For example, denote R as a set of intervals of neighborhood sizes, where a point falls outside of the mentioned margin. Furthermore, let Q be the discrete set of neighborhood sizes, which fall outside of the margin and either f(r) or mgr(r) is a critical distance. The critical distance is a neighborhood size on a common edge defined by linear segments of f(r) and mrg(r).

The anomaly score may be determined or otherwise computed by using one or more of three possible expressions 1-3, as follows.

(1) $\Sigma_{r\in Q}\text{conf}(f(r)-\text{mrg}(r))$, (2) $\int_{r\in R}|f(r)-\text{mrg}(r)|dr$, which can be reduced to a sum of areas of trapeziums, since both f(r) and mrg(r) are composed of linear parts and (3) $\int_{r\in R}\text{conf}(f(r)-\text{mrg}(r)dr$, where conf(r) is a non-linear confidence function being 0 for near distances and quickly approaching 1 for larger distances (e.g., described by the value $$1-\frac{1}{1+2x^2}\Big).$$

In this regard, a comparison processor compares the anomaly score (calculated via one or more of processes 1-3) with a threshold value. If the anomaly score is exceeds the threshold value, then the processor sets an alarm.

Because the proposed methods consider all available distances, the value of the anomaly score provided by expressions 1-3 is no longer dominated by single outliers as in the original method and, consequently, the proposed methods are more robust. The method of determining the values of the anomaly score provided by expressions 2 and 3 additionally consider the definition of the LOCI function f(r) among the critical distances and precisely integrate its difference to mrg (r), which further improves precision and robustness of the anomaly criterion. The most precise value for the anomaly score is provided by the method of expression 3, which includes both integration and the confidence function conf(d), however, it may be computationally demanding if numerical integration is required to compute the value. Advantageously, the presented definition of conf(d) allows analytical integration, so all three methods are computationally negligible in comparison with other components of the LOCI algorithms.

In general, the system implements a method that includes the steps of detecting a plurality of events within a security system, evaluating the events using one of a first expression defined by $\Sigma_{r\in Q}\text{conf}(f(r)-\text{mrg}(r))$, a second expression defined by $\int_{r\in R}|f(r)-\text{mrg}(r)|dr$ and a third expression defined by $\int_{r\in R}\text{conf}(f(r)-\text{mrg}(r))dr$, where r is a size of a neighborhood around a data point, f(r) is a Local Correlation Integral (LOCI) of r, mrg(r) is a margin of r, R is a predetermined set of intervals of neighborhood sizes (e.g., {[r1,r2], [r3,r4], [r5, r6], etc.), Q is a predetermined discrete set of neighborhood sizes and conf(d) is a non-linear confidence function being 0 for near distance to the data point and quickly approaching 1 for larger distances, comparing a value of the evaluated expression with a threshold value and setting an alarm upon detecting that the value exceeds the threshold value.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

detecting a plurality of events within a security system;

evaluating the events using one of a first expression defined by $\Sigma_{r\in Q}\text{conf}(f(r)-\text{mrg}(r))$, a second expression defined by $\int_{r\in R}|f(r)-\text{mrg}(r)|dr$ and a third expression defined by $\int_{r\in R}\text{conf}(f(r)-\text{mrg}(r))dr$, where r is a size of a neighborhood around a data point, f(r) is a Local Correlation Integral (LOCI) of r, mrg(r) is a margin of r, R is a predetermined set of intervals of neighborhood sizes, Q is a predetermined discrete set of neighborhood sizes and conf(d) is a non-linear confidence function being 0 for near distance to the data point and quickly approaching 1 for larger distances;

comparing a value of the evaluated expression with a threshold value; and setting an alarm upon detecting that the value exceeds the threshold value.

2. The method as in claim 1 wherein the detected events further comprise physical entry by a plurality of person through a plurality of portals, each portal having an electric lock that controls physical entry by the plurality of persons into a secured area of the security system.

3. The method as in claim 2 further comprising a time of entry through one of the plurality of portals.

4. The method as in claim 1 further comprising a time of entry of an authorized user into the secured area.

5. The method as in claim 1 wherein the detected events further comprise activation of a plurality of security sensors within a secured area of the security system.

6. The method as in claim 5 wherein the detected events further comprise a time between activation of each of the plurality of sensors of the security system.

7. The method as in claim 5 wherein the detected events further comprise detection of motion within the secured area.

8. An apparatus comprising:

an event processor that detects a plurality of events within a security system;

an evaluation processor that evaluates the events using one of a first expression defined by $\Sigma_{r\in Q}\text{conf}(f(r)-\text{mrg}(r))$, a second expression defined by $\int_{r\in R}|f(r)-\text{mrg}(r)|dr$ and a third expression defined by $\int_{r\in R}\text{conf}(f(r)-\text{mrg}(r))dr$, where r is a size of a neighborhood around a data point, f(r) is a Local Correlation Integral (LOCI) of r, mrg(r) is a margin of r, R is a predetermined set of intervals of neighborhood sizes, Q is a predetermined discrete set of neighborhood sizes and conf(d) is a non-linear confidence function being 0 for near distance to the data point and quickly approaching 1 for larger distances;

a comparison processor that compares a value of the evaluated expression with a threshold value; and an alarm processor that sets an alarm upon detecting that the value exceeds the threshold value.

9. The apparatus as in claim 8 wherein the detected events further comprise physical entry by a plurality of person through a plurality of portals, each portal having an electric lock that controls physical entry by the plurality of persons into a secured area of the security system.

10. The apparatus as in claim 9 wherein the detected events further comprise a time of entry through one of the plurality of portals.

11. The apparatus as in claim 8 further comprising a time of entry of an authorized user into the secured area.

12. The apparatus as in claim 8 wherein the detected events further comprise activation of a plurality of security sensors within a secured area of the security system.

13. The apparatus as in claim 12 wherein the detected events further comprise a time between activation of each of the plurality of sensors of the security system.

14. The apparatus as in claim 12 wherein the detected events further comprise detection of motion within the secured area.

15. An apparatus comprising:

a security system that protects a secured area having a plurality of zones;

a processor that detects a plurality of events within the security system including at least entry into at some of the plurality of zones;

a processor that evaluates the events using one of a first expression defined by $\Sigma_{r\in Q}\mathrm{conf}(f(r)-\mathrm{mrg}(r))$, a second expression defined b $\int_{r\in R}|f(r)-\mathrm{mrg}(r)|dr$ and a third expression defined by $\int_{r\in R}\mathrm{conf}(f(r)-\mathrm{mrg}(r))dr$, where r is a size of a neighborhood around a data point, f(r) is a Local Correlation Integral (LOCI) of r, mrg(r) is a margin of r, R is a predetermined set of intervals of neighborhood sizes, Q is a predetermined discrete set of neighborhood sizes and conf(d) is a non-linear confidence function being 0 for near distance to the data point and quickly approaching 1 for larger distances;

a processor that compares a value of the evaluated expression with a threshold value; and a processor that sets an alarm upon detecting that the value exceeds the threshold value.

16. The apparatus as in claim 15 wherein the detected events further comprise physical entry by a plurality of person through a plurality of portals, each portal having an electric lock that controls physical entry by the plurality of persons into a secured area of the security system.

17. The apparatus as in claim 16 wherein the detected events further comprise a time of entry through one of the plurality of portals.

18. The apparatus as in claim 15 further comprising a processor that compares values from at least two of the expressions with a respective threshold value and sets an alarm upon detecting that they both exceed the respective threshold.

19. The apparatus as in claim 15 further comprising a processor that compares values from all three of the expressions with a respective threshold value and sets an alarm upon detecting that they all exceed the respective threshold.

* * * * *